US007392629B1

(12) United States Patent
Bankston et al.

(10) Patent No.: US 7,392,629 B1
(45) Date of Patent: Jul. 1, 2008

(54) SUSPENDED CEILING SYSTEM

(75) Inventors: John D. Bankston, Amherst, OH (US); Gregory M. Ahren, Avon Lake, OH (US); John Harcula, Vermilion, OH (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 11/617,143

(22) Filed: Dec. 28, 2006

(51) Int. Cl.
*E04B 9/36* (2006.01)

(52) U.S. Cl. ..... 52/506.07; 52/664; 52/716.1

(58) Field of Classification Search ... 52/506.06–506.1, 52/664–667, 716.1; 362/147, 148, 150, 151, 362/225, 404; 454/248, 284, 292, 296; D26/72, D26/74

See application file for complete search history.

(56) References Cited

U.S. PATENT DOCUMENTS 3,032,833 A 5/1962 Stanley
3,190,208 A 6/1965 Styne et al.
3,640,042 A 2/1972 Kidney
4,064,671 A 12/1977 Sauer
4,535,580 A 8/1985 Shirey
4,744,188 A 5/1988 Ahren
5,363,622 A 11/1994 Sauer

OTHER PUBLICATIONS

USG Interiors, Inc., Drawing No. 15715 entitled "Strut Stabilizer Bar/Spacer Channel", dated Aug. 6, 2002.

*Primary Examiner*—Robert Canfield
*Assistant Examiner*—Bryan Eppes
(74) *Attorney, Agent, or Firm*—Pearne & Gordon LLP

(57) ABSTRACT

A suspended ceiling comprising a pair of parallel main grid tees, the tees being of the type having its panel supporting flange forming a hollow with a downwardly open slot, a plurality of identical stabilizer bars spacing said main grid tees a predetermined distance, trim strips assembled on said main grid tees, the trim strips each having a first portion hooked into the hollow flange of a respective tee and a second portion abutting a web of the respective tee, the stabilizer bars being arranged to engage opposite sides of reinforcing bulbs of the main grid tees to hold the same against relative lateral horizontal movement from their desired positions, the stabilizer bars engaging the trim strips in a manner that holds their second portions in abutment with the webs of their respective tees. The stabilizer bars are formed of sheet metal and have bendable tabs that can be bent to hold said trim strip second portions in contact with the webs of their respective tees. The trim strips have a G-shaped profile that is adapted to receive portions of cross tee connectors assembled through slots in the webs of the main grid tees.

3 Claims, 4 Drawing Sheets

SUSPENDED CEILING SYSTEM

BACKGROUND OF THE INVENTION

The invention relates to suspended ceiling systems and, in particular, to accessories for customizing the appearance of standard rectangular grid supported ceilings.

PRIOR ART

Typically, suspended ceilings in commercial buildings and like applications use a rectangular metal grid carried by suspension wires hung from overhead supporting structure. The grid, most frequently, is made up of main runners and cross runners both with inverted tee shaped cross sections. Panels are laid onto the lower flanges of the tees to complete the ceiling. Ordinarily, the grid pattern is an array of square or rectangular modules typically on 4' or 5' centers, or like metric dimensions, and fractions thereof. Suspended ceiling systems as described have evolved to the point that they can be economical to produce and install. The panels are available with various surface textures and designs on their visible faces and various edge treatments to provide different appearances in the finished ceiling. Similarly, the grid tees are produced with different widths and/or are assembled with the panels to be partially or fully concealed. These variants can produce a range of different looks in the finished ceiling, but there remains a continued interest in obtaining still greater variation in the basic planar regular square or rectangular repeating pattern.

SUMMARY OF THE INVENTION

The invention combines unique grid stabilizer bar and grid trim members that allow the grid runner spacing to be varied to any desired dimension and/or the planar expanse of the finished ceiling surface to be interrupted with parallel feature trim strips. The stabilizer bar has the basic shape of a simple angle section with unique cutouts at its opposite ends. By adjusting the longitudinal spacing of the cutouts at opposite ends of the bar, the bar can be used to achieve essentially any desired spacing between a pair of parallel tees. The trim members or strips are assembled on main runner grid tees as a feature that gives a distinctive linear look to the ceiling and thus differentiates it from conventional rectangular grid installations.

The stabilizer bar is arranged to be installed on a pair of main runner grid tees of conventional construction by simple manipulation of these elements and without the need for separate fasteners. Similarly, the trim members can be assembled on known styles of grid tees with limited assembly effort and without separate fasteners when it is used with the stabilizer bar of the invention.

When the stabilizer bar and trim member are used together, the stabilizer bar is formed with an integral tab or flag that, prior to assembly with the trim member, is bent out of the original plane of its parent sheet stock and when assembled with the trim member is bent down to its original plane. In this returned position, the tab or flag captures a part of the trim member and prevents the trim member from moving out of its installed position. In the preferred embodiment, the trim member is arranged to project, fin-like, downwardly from the plane of the ceiling panels and is thereby enabled to give a distinctive linear look to the ceiling.

DESCRIPTION OF THE PREFERRED EMBODIMENT

Figure 1:
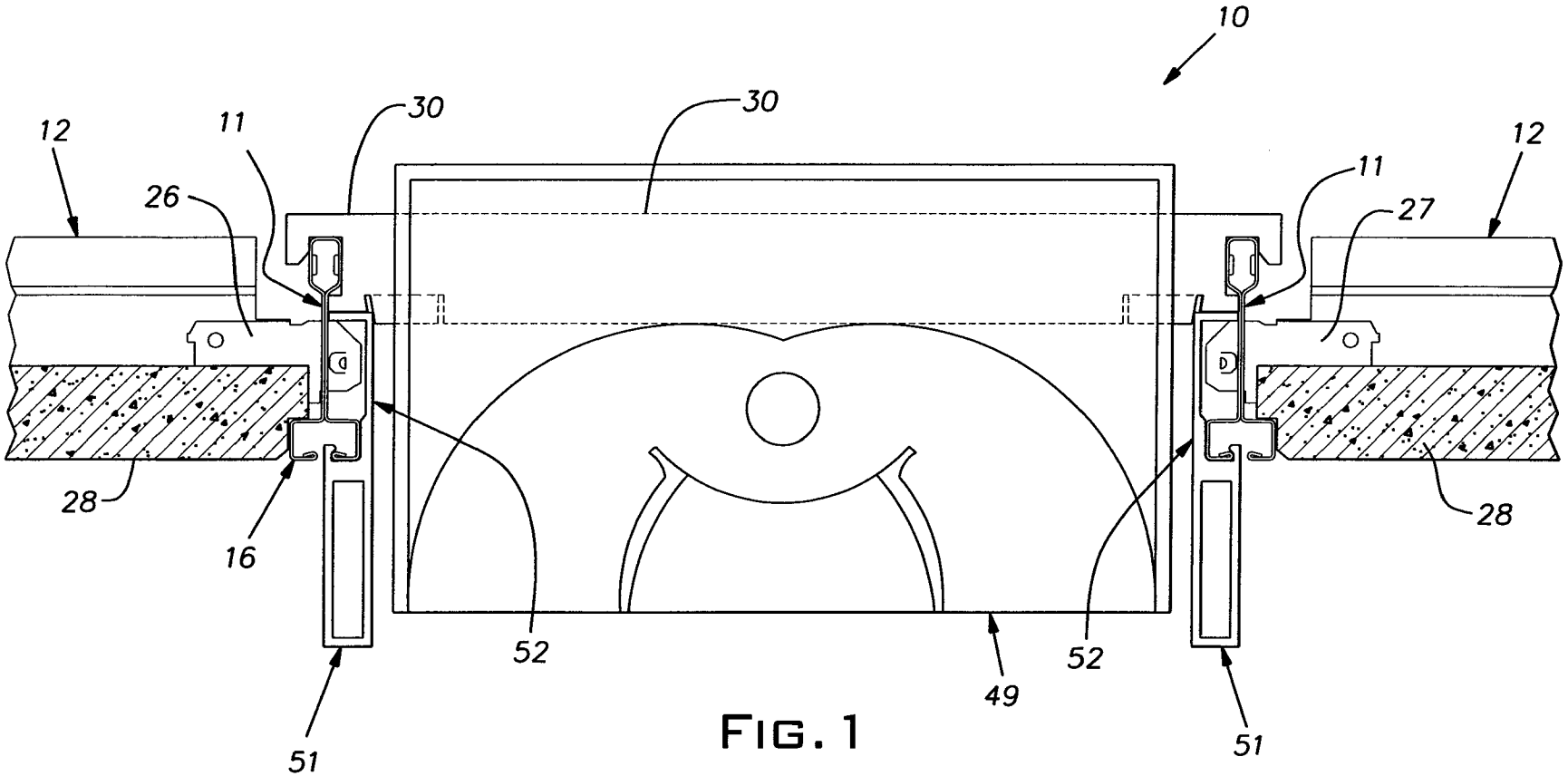
FIG. 1 is a fragmentary elevational cross-sectional view of a suspended ceiling installation utilizing the invention.

Referring now to the drawings, there is partially shown a suspended ceiling system 10 having parallel main runners or main grid tees 11 and cross runners or grid cross tees 12. U.S. Pat. No. 4,535,580, the disclosure of which is incorporated herein, illustrates an example of the construction of the tees in greater detail. The illustrated tees 11, 12, are of the open slot or bolt slot style, where a ceiling panel supporting flange 16 on the lower side of the tee is a hollow box-shaped structure with a slot 17 on its lower face. The flange 16 is channel-like with the letter "C" lying on its side. The slot 17 is symmetrically arranged on both sides of a central plane defined by a double wall web 13. The illustrated tees 11, 12, are made of a single strip of sheet metal, typically steel. The tees 11, 12 have a hollow rectangular upper reinforcing bulb 14. Margins of the lower sides or parts 19 of the box-like flange 16 that forms the boundary of the open slot 17 each have an internal hem 21 formed by a fold of the sheet metal extending a short distance away from the slot 17 and terminating at an edge 22.

Figure 2:
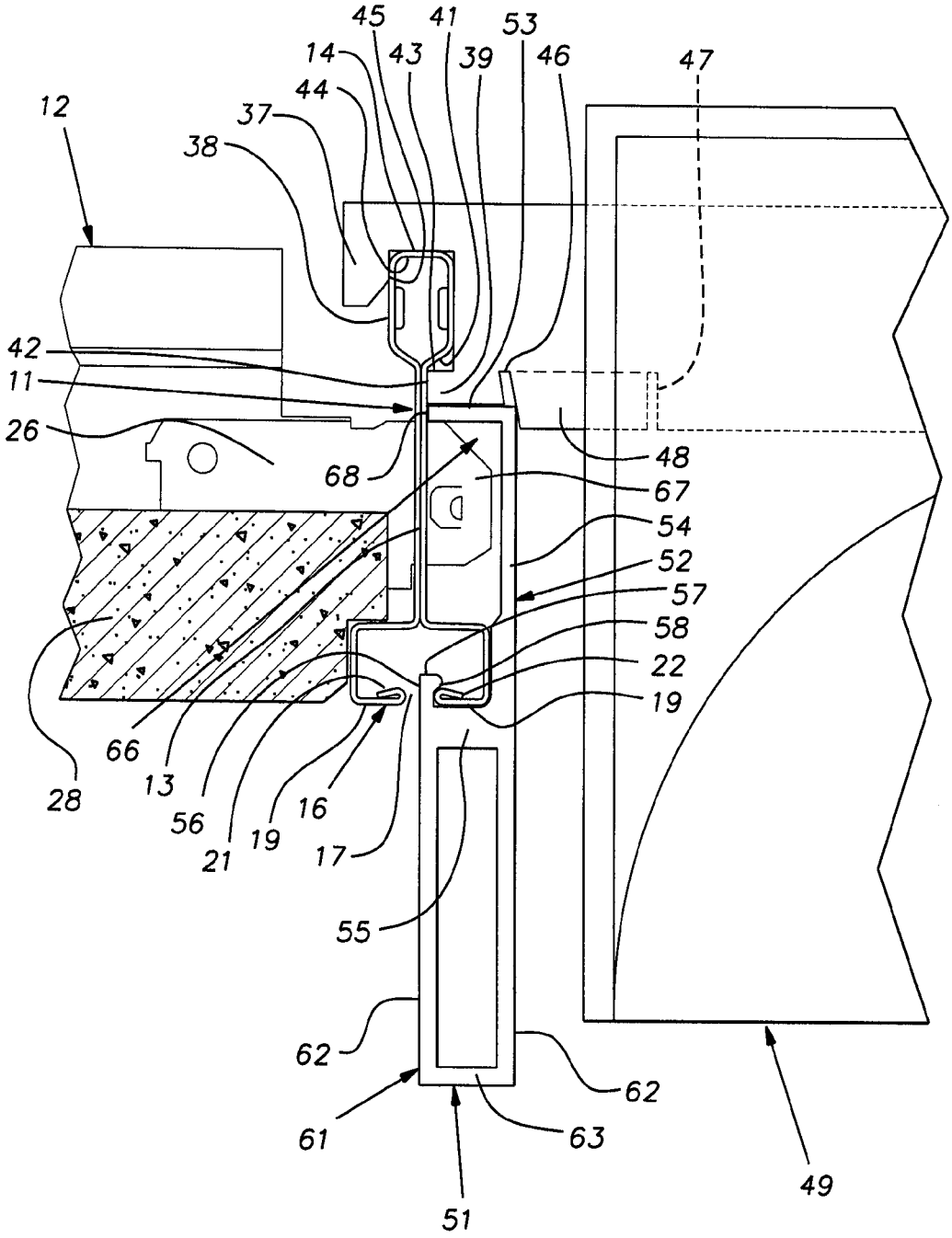
FIG. 2 is an end view of the trim strip of the invention.

The cross runners or cross tees 12, as is conventional, are provided with an end connector 26 at each of their ends. The end connector 26 is received in a through slot in the web 13 of the main tees 11, the slots being formed at regularly spaced locations along the length of the main tee. As indicated in FIGS. 1 and 2, the connectors 26 extend beyond the web 13 a distance typically greater than one-half the width of the hollow reinforcing bulb 14.

The cross tees 12 can have a cross-section identical or similar to that of the main tees 11. Ceiling panels 28 are commonly rabbetted at their peripheries in a manner that when assembled on the grid tees 11, 12, the lower visible faces of the panels are flush, i.e. coplanar with the lower sides of the lower flange parts 19.

Figure 4:
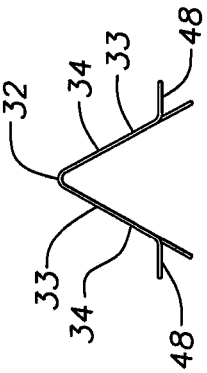
FIG. 4 is an end view of the stabilizer bar of the invention.
Figure 3:
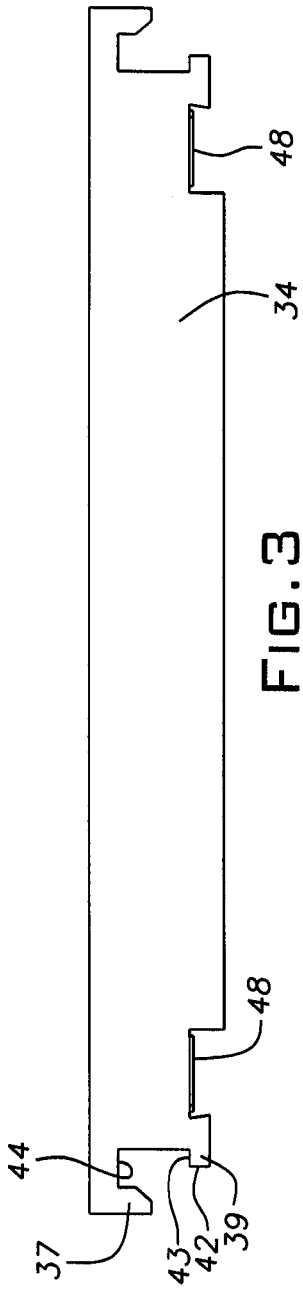
FIG. 3 is a side view of the stabilizer bar of the invention.
Figure 5:
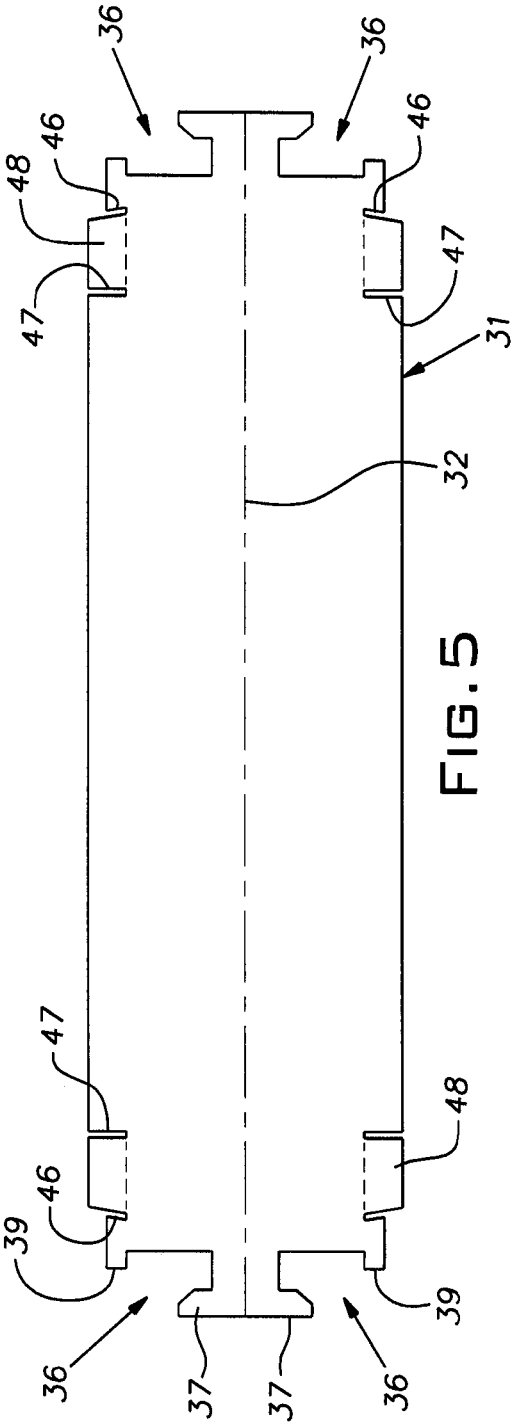
FIG. 5 is a top view of a planar blank used to make the stabilizer bar of FIG. 3.

The illustrated pair of main tees 11 are spaced and held in parallel relation by a plurality of stabilizer bars 30 spaced at suitable locations along the length of the main tees. Such spacing can be the distance of a modular dimension of the ceiling system, typically, 4' or 5' or a metric equivalent. Other spacings of the stabilizer bars 30 can be used as appropriate. The stabilizer bar 30, preferably, is a relatively plain sheet metal part that can be made with simple tooling. With reference to FIG. 5, the stabilizer bar 30 can be blanked from sheet metal stock such as light gauge galvanized steel. A stabilizer blank 31, elongated in form, has each end with a profile that is symmetrical about a longitudinal axis or center line 32 and with that of the opposite end. After its profile is formed, the blank 31 is folded along its longitudinal axis 32 into the V-shaped acute angular cross-section displayed in FIG. 4 so that the stabilizer bar has two legs 33, in the vernacular of a structural angle, each leg having a face 34. Each end profile of the blank 31 has a pair of generally rectangular cutouts 36 that in the projection or view of FIG. 3 fit relatively closely with the horizontal and vertical dimensions of the reinforcing bulb 14 of a main tee 11. Specifically, each cutout has a hook element 37 adapted, when the stabilizer bar 30 is installed, to overlie the top of the bulb 14 and embrace an upper portion of the vertical side of the bulb, designated 38, distal from the main body of the stabilizer bar. Additionally, each cutout 36 has a finger 39 projecting away from the main body of the stabilizer bar 30 and adapted to closely fit under a lower surface 41 of the reinforcing bulb 14 and abut or nearly abut the grid tee web 13 with an edge 42 lying in a generally vertical plane parallel to the web.

From the blanked flat configuration shown in FIG. 5, the blank 31 is folded along a longitudinal center line 32. When the stabilizer bar 30 is installed, the cutouts 36 at each end of the stabilizer bar restrain relative movement between the grid tee 11 both horizontally and vertically. Edge surfaces 43, 44, formed by the cutout 36, lying in horizontal planes engage the underside and top of the bulb 14 to prevent relative vertical movement and edge surfaces 42, 45 lying in vertical planes prevent relative horizontal movement.

Two parallel slots 46, 47 are cut into the body of the blank 31 perpendicular to its longitudinal axis 32 at each end on each side. Adjacent slots 46, 47 create a tab or flag 48 which, when the stabilizer bar is first made, is bent out of the plane of the respective leg. The tabs 48 are bent so that they lie in a common horizontal plane when the stabilizer bar is in its initially installed position with its corner (formed on the bend line along its longitudinal axis 32) at the top and the legs 33 depending from the corner.

Figure 6:
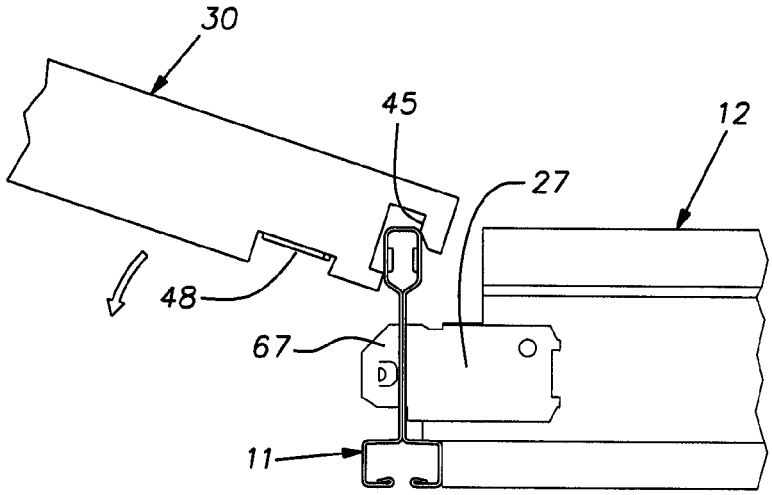
FIG. 6 illustrates an initial step in assembling the stabilizer bar on a main tee.
Figure 7:
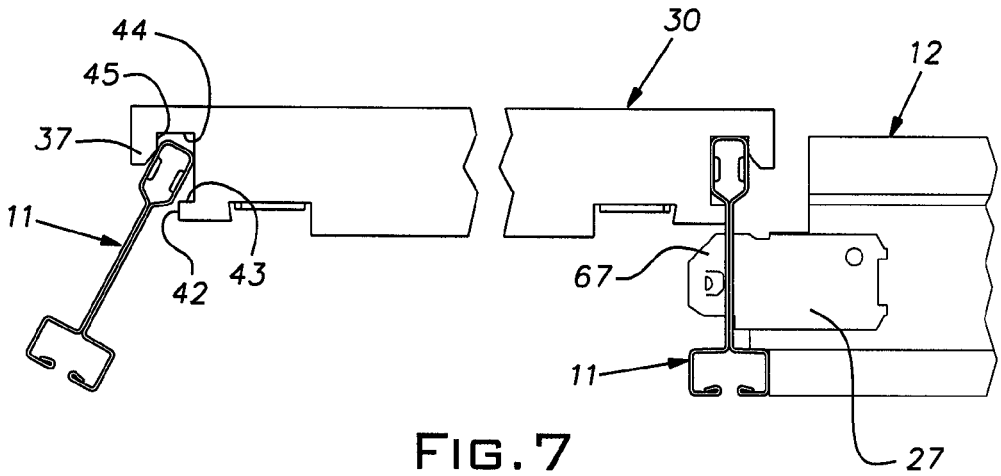
FIG. 7 is an illustration of an intermediate step in the assembly of the stabilizer bar on a second main tee.

Various steps or techniques can be used to assemble the stabilizer bars 30 with the ceiling grid system 10. In one manner, the main tees 11 are suspended and, thereafter, the cross tees 12 and stabilizer bars 30 are assembled starting at one edge of the ceiling and working in the direction in which the cross tees 12 and stabilizer bars 30 extend. Assuming one or more rows of cross tees 12 are suspended in position according to regular practice, a row of stabilizer bars 30 can be assembled. Each stabilizer bar 30 is angled down from above the plane of the main tees 11 and the lower end is positioned, as indicated in FIG. 6, with its cutout over the bulb 14 of the main tee. The stabilizer bar 30 is then rotated downwardly so that it is at or near a horizontal orientation. At this time, a parallel main tee 11 can be twisted out of its normal orientation wherein its web 14 is vertical to a condition where the web is out of plumb as indicated in FIG. 7. This temporarily rotated or cocked position of the adjacent parallel main tee 11 enables the installer to position the bulb 14 into the adjacent cutouts 36. The cocked main tee is then allowed to twist back to its normal orientation. During this manipulation of the second main tee 11 and assembly with a stabilizer bar 30, this second main tee can be free of cross tees so as to not impede the rotation or cocking of the main tee and insertion of its bulb into the cutouts 36 of the stabilizer bar. Other techniques and steps can be implemented for assembling the stabilizer bars 30 on the main tees.

The spacing of the stabilizer bars 30 can be determined by the length of light fixtures, air vents, or other accessories disposed laterally between the associated main runners 11 and longitudinally between the stabilizer bars FIGS. 1 and 2 illustrate, somewhat schematically, an elongated light fixture and the stabilizer bars are disposed at each end of the fixture. A similar arrangement can be visualized where, rather than the light fixture, an air duct or other accessory 49 is disposed in the ceiling system 10.

The suspended ceiling system includes a trim strip 51 preferably formed as an extrusion of suitable material such as aluminum or a dimensionally stable plastic or composite. The trim strip 51 can be supplied as a straight elongated member of 10' or 12' in length or metric equivalent, for example. The strip 51 has an upper portion 52 that has the general cross-sectional configuration of the letter "G". The wall areas of this configuration include a horizontal top 53, a vertical side 54, a horizontal part 55, a vertical short side 56, and a short narrow horizontal grip 57. A free edge of the grip 57 has its underside rounded or otherwise tapered at 58 so that preferably at least a portion of its local surface area has an upward inclination from the horizontal, preferably.

The illustrated trim strip 51 has a lower portion in the form of a hollow rectangular box section 61 formed at its top by the horizontal wall part 55, depending parallel vertical walls 62 and a lower wall 63. The trim strip 51 can be installed on the main tees 11 after the cross tees 12 and stabilizer bars 30 are assembled in place. It will be seen that the walls 53, 54 and 55 form a hollow zone 66 of sufficient width and height to fully receive the portion 67 of a connector 26 of a cross tee 12 that extends through the main runner web 13. The trim strip 51 is proportioned so that the underside surface of the horizontal top 53 rests n the upper edges of the connector portions 67 or immediately above these edges so that the connectors are able to assist in the retention of the trim strip on the main tee 11.

The trim strip 51 is installed by aligning it with a main tee 11, tilting it out of plumb and inserting the short wall 56 and grip 57 into the open slot 17. With the underside surface 58 of the grip 57 overlying the area of the flange 16 formed by the hem 21, the trim strip is pivoted to a plumb position where a distal or free edge 68 of the top wall 53 abuts the tee web 13. With the trim strip 51 provisionally held in this position manually or with suitable temporary clamping elements, the tabs or flags 48 can be manually bent downwardly to the position or elevation, shown in FIGS. 1 and 2, in which they lie below the top 53 of the strip 51. In this position, the tabs 48 lock the trim strips 51 in their installed position. Specifically, the tabs 48 prevent the trim strips 51 from pivoting about their longitudinal axis in a direction reversed from that in which they were installed. The grip 57 and other geometry of the strip profile is such that as long as the strip cannot pivot about its longitudinal axis it cannot in normal service separate from the associated grid tee 11.

The trim strip can be provided with any desired finish and/or color. Additionally, the trim strip can be modified to change its appearance such as by altering the height or width of the lower section 61 or eliminating it altogether. Ordinarily, the stabilizer bars 30 are used at specific areas in a ceiling while in surrounding or adjacent areas conventional cross tees are used to space parallel main tees. The stabilizer bars 30 can be used with standard non-slotted grid tees and can be used in applications where the trim strip is not used. In the latter case, the tabs 48 can be omitted, for example, by not cutting the slots 46, 47.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A suspended ceiling comprising a pair of parallel main grid tees, the tees each having an upper reinforcing bulb and vertical web below the reinforcing bulb and being of the type having its panel supporting flange forming a hollow with a downwardly open slot, a plurality of identical stabilizer bars spacing said main grid tees a predetermined distance, trim strips assembled on said main grid tees, the trim strips each having a first portion hooked into the hollow flange of a respective tee and a second portion abutting a web of the respective tee, the stabilizer bars being arranged to engage opposite sides of reinforcing bulbs of the main grid tees to hold the same against relative lateral horizontal movement from their desired positions, the stabilizer bars engaging the trim strips in a manner that holds their second portions in abutment with the webs of their respective tees.

2. A suspended ceiling as set forth in claim 1, wherein the stabilizer bars are formed of sheet metal and have bendable tabs holding said trim strip second portions in contact with the webs of their respective tees.

3. A suspended ceiling as set forth in claim 1, wherein said trim strips have a G-shaped profile that is adapted to receive portions of cross tee connectors assembled through slots in the webs of the main grid tees.

* * * * *